United States Patent [19]

Javelle

[11] Patent Number: 4,651,924

[45] Date of Patent: Mar. 24, 1987

[54] TWISTED ANGLE TIE-BAR FOR RAILWAY TIE

[75] Inventor: Robert Javelle, Avesnes/Helpe, France

[73] Assignee: Trancel, Avesnes/Helpe, France

[21] Appl. No.: 760,679

[22] Filed: Jul. 30, 1985

[51] Int. Cl.[4] ..... E01B 3/48

[52] U.S. Cl. ..... 238/117; 238/89; 52/736

[58] Field of Search ..... 238/54, 55, 56, 58, 238/59, 84, 85, 88, 89, 91, 115, 116, 117; 52/720, 736, 738, 600, 601, 602

[56] References Cited

U.S. PATENT DOCUMENTS 3,371,866 3/1968 Sonneville ..... 238/58
4,416,419 11/1983 Ohno ..... 238/89

FOREIGN PATENT DOCUMENTS 1429382 1/1966 France .
2283258 3/1976 France .
2530691 1/1984 France ..... 238/85

*Primary Examiner*—Robert B. Reeves
*Assistant Examiner*—Scott H. Werny
*Attorney, Agent, or Firm*—Roberts, Spiecens & Cohen

[57] ABSTRACT

A tie-bar for mixed railway tie, constituted by an angle shaped in the vicinity of each of its ends, over an intermediate part joining the central part of the angle to each of its end parts, so that each end part occupies in each block a position in which one of its wings passes at a distance beneath the vertical orifices for passage of rail screws, its other wing passing at a distance along the orifices.

3 Claims, 3 Drawing Figures

TWISTED ANGLE TIE-BAR FOR RAILWAY TIE

FIELD OF THE INVENTION

The present invention relates to twisted angle tie-bars for the ties of railways of the mixed concrete-steel type.

PRIOR ART

The use of angles as tie-bars for mixed concrete-steel ties is known. French Pat. No. 1 429 382 proposes a tie equipped with a twisted angle tie-bar which is perforated at each of its ends embedded in the blocks to allow the passage and anchoring of bolts or screws for fixing the rails. Such a tie-bar, whose manufacture involves the use of powerful means for cutting out the perforations, also presents the drawbacks of affecting the mechanical strength of the angle, of necessitating high precision of positioning during manufacture of the ties and of requiring a very careful electrical insulation of the rails laid down on these ties since the bolts for fixing the rails are in direct contact with the tie-bar.

French patent application No. 82 07807 also discloses an angle tie-bar having wings extended locally at each of its ends in order to reduce the dimensions of the latter and to allow them to be embedded, between the rail screws, in the longitudinal central zone of the blocks. However, this solution, which provides electrical insulation, involves disposing the rail screws on either side of the longitudinal median axis of the blocks, this presenting the drawback of not allowing the use of the existing mechanized automatic track-laying machines which require an alignment of the rail screws.

SUMMARY OF THE INVENTION

To overcome the drawbacks of the solutions set forth above, it is an object of the invention to provide a non-perforated angle tie-bar allowing the alignment of the rail screws along the longitudinal median axis of the tie, which is economical to manufacture and adapted to be mounted easily in the blocks without risk of direct electrical contact with the rail fastening means.

To attain the object set forth hereinabove, the invention provides an angle tie-bar presenting a non-deformed central part separating the two blocks, comprising at each of its ends:

an end part which has undergone a transverse movement of rotation such that, in position of assembly, one wing of the end part may pass at a distance beneath the vertical orifices for passage of the rail screws and its other wing passes at a distance along said orifices. The end part is preferably not deformed with respect to its initial profile and its section occupies a position offset by about 45° with respect to that of the central part;

a shaped intermediate part which joins the end part to the central part of the angle. The intermediate part which is advantageously twisted is positioned on the angle to come into position in each block, between the inner orifice for passage of the rail screws and the inner lateral face of the block.

BRIEF DESCRIPTION OF THE DRAWINGS

The invention will be more readily understood on reading the following description with reference to the accompanying drawings, in which.

DETAILED DESCRIPTION OF A PREFERRED EMBODIMENT

Figure 3:
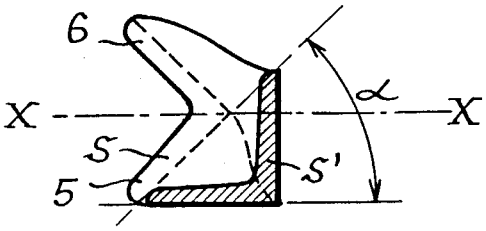
FIG. 3 is an enlarged sectional view of the tie-bar alone taken on line III—III in FIG. 1.

Referring now to the drawings, the tie-bar of the invention is constituted by a metal angle (FIG. 1) shaped near each of its ends, on an intermediate part 12, so that its end parts 13 undergo a transverse movement of rotation about an axis lying in the vicinity of the outer edge of one leg or wing 5 (FIG. 3) of the angle 1, so that the sections S' of the end parts 13 occupy, with respect to section S of the central part 11, a position offset towards the outer central edge of the angle part 11, by an angle $\alpha$ of about 45°. That portion of the axis about which transverse rotation of the end parts 13 is effected and which determines the position of these parts with respect to orifices 3 for passage of rail screws, may move away as much as is necessary from the outer edge of the wing 5, this axis being able to lie for example in the median zone of the wing 5.

The end parts 13 are preferably not deformed with respect to their initial profile.

The intermediate parts 12 for connection of the end parts 13 with the central part 11, may be made by twisting, bending or the like. Such forming may be effected by an appropriate means enabling a regular and progressive deformation of the metal to be obtained.

In order to facilitate understanding, a more detailed description of the preferred embodiment of the tie-bar of the invention is given hereinafter, situating said tie-bar with respect to the relative position that it occupies as mounted in the blocks of a mixed tie normally laid on the ground.

Figure 1:
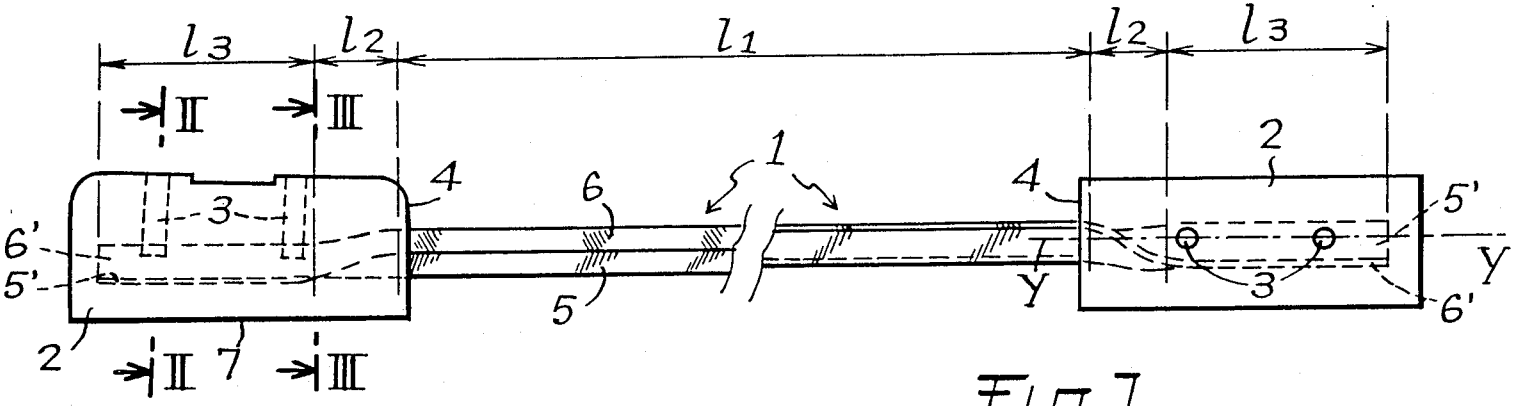
FIG. 1 shows a mixed tie equipped with the tie-bar of the invention, in front view for its left half and in plan view for its right half.
Figure 2:
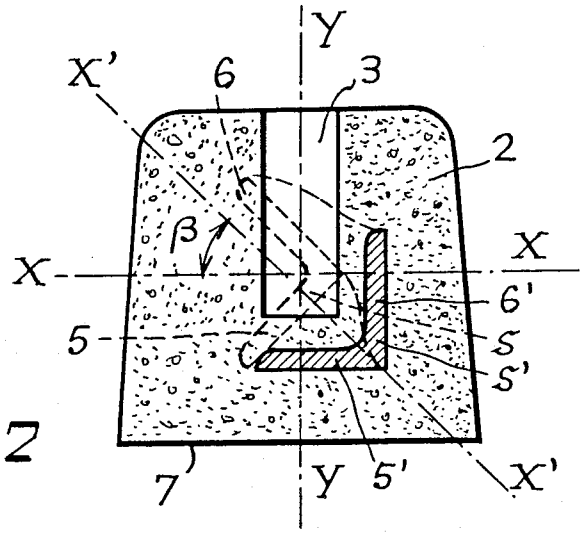
FIG. 2 is an enlarged sectional view taken on line II—II in FIG. 1.

FIGS. 1 and 2 show a mixed tie equipped with the twisted angle tie-bar 1 of the invention. The concrete blocks 2 used are of the type each comprising two vertical orifices 3, provided with threaded linings (not shown) making it possible to fix the rail by rail screws. The vertical orifices 3 are aligned along the longitudinal median axis YY of the blocks.

The angle tie-bar 1 of the invention presents:

a central part 11, of section S, not deformed with respect to its initial profile, of a length at least equal to the space defined by the inner lateral faces 4 of the blocks 2. The central part 11 which is centered in the longitudinal axial zone of the blocks 2 is oriented so that the bisector plane XX of its lower and upper wings 5 and 6, respectively, is horizontal, i.e. parallel to the base surface 7 of the blocks 2;

at each of its ends embedded longitudinally in the blocks 2, a part 13, of section S', not deformed with respect to its initial profile and a shaped intermediate part 12 joining the end part 13 and the central part 11.

The end parts 13 which are oriented so that the bisector planes X'X' of their wings 5', 6' form an angle $\beta$ of 45° with respect to axis XX of the central part 11, occupy in the blocks 2 a position in which their wings 5' extend horizontally at a distance beneath the vertical orifices 3, the other wings 6' extending vertically at a distance from said orifices. This arrangement ensures free passage of the rail screws and provides a good electrical insulation between the latter and the tie-bar.

The shaped intermediate parts 12, which are embedded in each block 2 between the inner lateral face 4 of the block and its inner orifice 3 for fixation of the rail, are twisted over their entire length. They gradually connect the corresponding respective wings (5' and 5, 6' and 6) of the end parts 13 and the central part 11.

The tie-bar of the invention, which therefore makes possible manufacture of a mixed tie in which the orifices for fixation of the rail are aligned along the longitudinal median axis of the tie, makes it possible to use existing mechanized automatic track-laying machines. Furthermore, manufacture does not require equipment of unusual design and is effected in accordance with a rational modus operandi.

Furthermore, the manufacture of mixed ties using the tie-bar of the invention is easy, therefore inexpensive, as said tie-bar does not have to be positioned in the blocks with precision.

What is claimed is:

1. A tie-bar for railway ties comprising an angle member including wings extending at right angles to one another, said angle member having opposite end portions embedded in respective concrete blocks provided with vertical orifices therein which open upwardly to receive anchoring means for a rail, the vertical orifices in the concrete blocks being aligned along a longitudinal median axis of the blocks, and a central portion joining said end portions and extending between said blocks, said wings in said central portion forming an angle relative to said blocks, said end portions of said angle member each including a twisted, intermediate part and an end part, said end portions being twisted relative to said central portion about an axis passing through one of said wings while maintaining substantially constant the angle between the wings of the angle member and thereby not deforming the profile of the angle member, said end part being twisted through an angle relative to said central portion so that the wings of each said end part are positioned within its respective said block such that one of the wings of each end part extends horizontally beneath the orifices while the other of the wings of each end part extends vertically adjacent the orifices in spaced relation therewith so that said wings line outside said orifices and do not penetrate therein, said twisted part joining said central portion and said end parts.

2. A tie-bar as claimed in claim 1 wherein said end parts are twisted relative to said central portion about said axis which passes through an outer edge of said one of said wings.

3. A tie-bar as claimed in claim 1 wherein the angle through which said end parts of said angle member are twisted relative to said central portion is 45°.

* * * * *